US006440017B1

(12) United States Patent
Anderson

(10) Patent No.: US 6,440,017 B1
(45) Date of Patent: Aug. 27, 2002

(54) METAL BAT HAVING IMPROVED BARREL STRUCTURE

(76) Inventor: Steven L. Anderson, 321 Avocado St., Unit D, Costa Mesa, CA (US) 92627

( * ) Notice: Subject to any disclaimer, the term of this patent is extended or adjusted under 35 U.S.C. 154(b) by 0 days.

(21) Appl. No.: 09/428,445

(22) Filed: Oct. 28, 1999

(51) Int. Cl.[7] ..... A63B 59/06
(52) U.S. Cl. ..... 473/566
(58) Field of Search ..... 473/564–568, 473/457

(56) References Cited

U.S. PATENT DOCUMENTS

| | | | | |
|---|---|---|---|---|
| 3,479,030 A | * | 11/1969 | Merola | 473/566 |
| 4,505,479 A | * | 3/1985 | Souders | 473/566 |
| 5,722,908 A | * | 3/1998 | Feeney et al. | 473/566 |
| 5,931,750 A | * | 8/1999 | MacKay, Jr. | 473/566 |
| 6,053,828 A | * | 4/2000 | Pitsenberger | 473/566 |

FOREIGN PATENT DOCUMENTS

| | | | |
|---|---|---|---|
| JP | 5-57042 | * | 5/1993 |

* cited by examiner

*Primary Examiner*—Mark S. Graham
(74) *Attorney, Agent, or Firm*—Morland C. Fischer

(57) ABSTRACT

A metal bat for playing softball or baseball having a two-part barrel structure for localizing the hitting area of the bat to the barrel and isolating the hitting area from the handle at which the bat is gripped. A hollow metallic inner shell extends continuously from an end cap of the bat to an end knob and includes a first end forming the handle, a second end forming the barrel and a tapered region lying therebetween. A metallic outer sleeve surrounds the barrel at the second end of the metallic inner shell between the end cap and a thickness transition area of the inner shell located at the tapered region. The barrel is adapted to flex symmetrically between a barrel supporting flange of the end cap and the thickness transition area at the tapered region in response to the bat striking a ball.

5 Claims, 2 Drawing Sheets

METAL BAT HAVING IMPROVED BARREL STRUCTURE

BACKGROUND OF THE INVENTION

1. Field of the Invention

This invention relates to a metal bat for playing softball or baseball. The bat has a two-part barrel structure for localizing the hitting area and for isolating the hitting area from the handle so that the bat is capable of flexing symmetrically between the end cap of the barrel and a thickness transition area where the barrel meets the handle taper.

2. Background Art

Metal bats are now common in the sports worlds for playing softball and baseball. Conventional metal bats typically are manufactured from a hollow metal shell that runs continuously between the handle at which the bat is gripped to the barrel at which the ball is hit. Because of this conventional one-piece bat construction, there is no way to localize the hitting area of the bat so as to isolate the hitting area from other regions (i.e. the handle) of the bat. What is more, there is no region at which the conventional metal bat may easily flex in response to its impact with a ball, such that the bat remains relatively stiff during the batter's swing and subsequent contact with the ball.

As a consequence of the foregoing, conventional metal bats are typically inefficient and require the batter to exert a relatively large swinging force to drive the ball. In addition, such conventional metal bats do not readily dissipate the impact forces created during contact with a ball and, therefore, are undesirably susceptible to damage (e.g. dents).

Therefore, what is needed a metal bat having an improved barrel structure that is adapted to flex symmetrically along the impact area so as to more efficiently transfer the impact forces that are generated when the bat strikes a ball in order to drive the ball a relatively long distance with respect to the force exerted during the batter's swing.

Examples of metal bats having a two-part barrel structure are available by referring to the following United States patents:

U.S. Pat. No. 5,415,398 May 16, 1995

U.S. Pat. No. 5,899,823 May 4, 1999

SUMMARY OF THE INVENTION

A hollow metal bat is disclosed of the type commonly used for playing softball or baseball. The metal bat has a handle portion at which the bat is gripped, a barrel portion at which contact is made with a ball, and a tapered portion running between the handle and the barrel portions. The metal bat of this invention has an improved two-part barrel structure to provide a more efficient transfer of the impact forces that are generated when the bat hits the ball so as to drive the ball a relatively long distance with respect to the force generated during the batter's swing. More particularly, the bat includes a metallic inner shell that runs continuously from the end knob of the handle portion to the end cap of the barrel portion. Surrounding the inner shell along the barrel portion is a metallic outer sleeve. The inner shell is swaged to fit inside the outer shell so that the inner shell and outer sleeve are held in face-to-face engagement, one above the other, along the entire length of the barrel portion. The outer sleeve of the barrel portion terminates at a thickness transition area of the inner shell that is located at the tapered portion where the barrel portion meets the handle portion. The thickness transition area of the inner shell is formed by swaging the handle and tapered portions to increase the wall thickness at the handle side of the inner shell by approximately ten percent. The bat is completed by a weight that fills the end of the barrel portion adjacent the end cap so as to dampen vibrations and control the resonance of sound waves that travel longitudinally along the bat. The end cap has an inwardly projecting flange that functions to support one end of the two-part barrel structure, and the thickness transition area functions to support the opposite end of the two part barrel structure.

By virtue of the two-part barrel construction herein described, the hitting area of the bat is confined to the barrel. The addition of the outer sleeve over the inner shell allows the hitting area of the barrel to be isolated from other areas of the bat. Moreover, the opposing supports established by the flange of the end cap and the thickness transition area at the tapered portion enable the barrel to flex symmetrically in response to the barrel making contact with a ball so that the bat is capable of driving the ball a longer distance with less force generated during the batter's swing while preventing the formation of dents.

DETAILED DESCRIPTION

Figure 1:
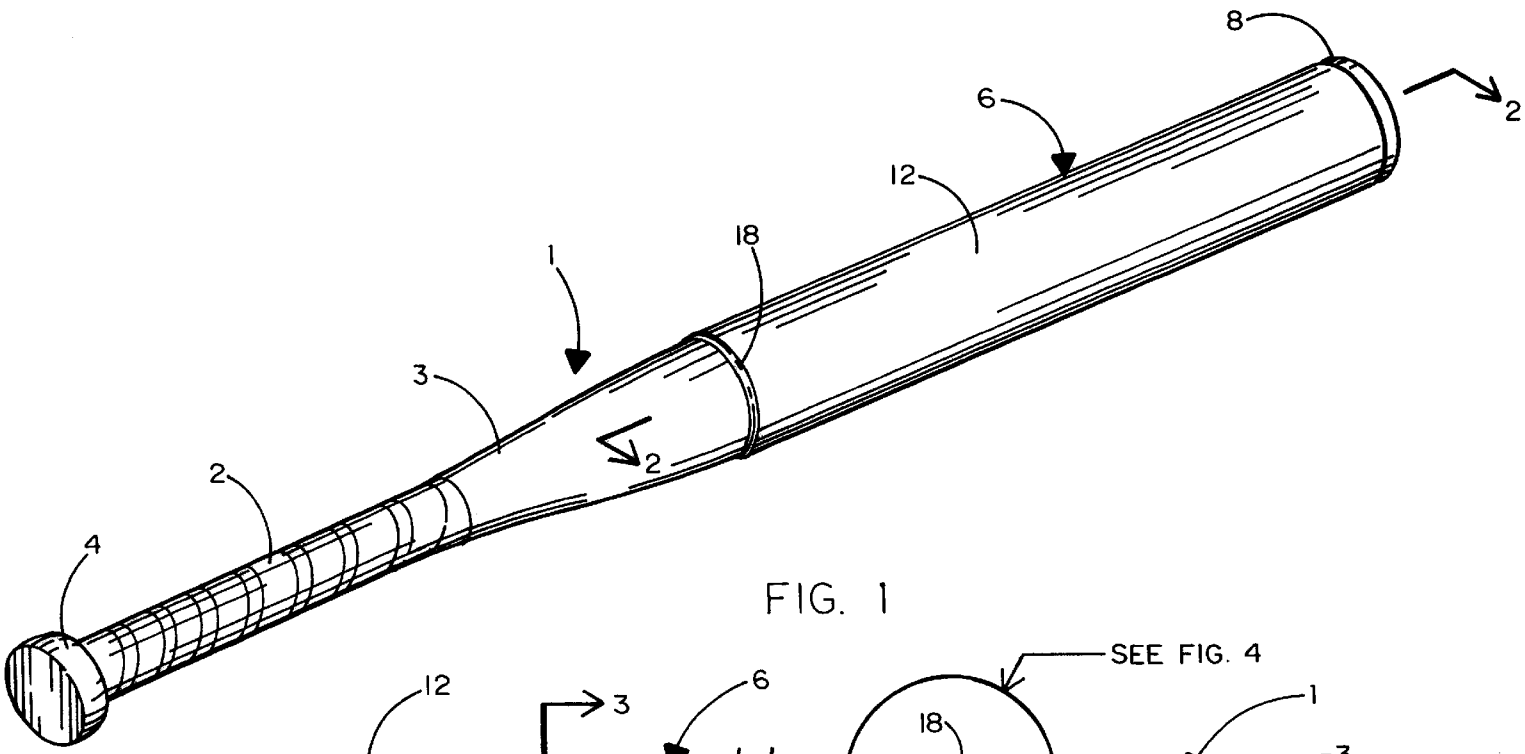
FIG. 1 shows a metal baseball or softball bat having an improved two-part barrel structure which forms the present invention.

The metal bat 1 which forms the present invention is illustrated in FIG. 1 of the drawings. While the metal bat 1 has particular application for playing softball, it may also be used to play baseball. Like conventional metal bats, the bat 1 is of hollow construction and includes a metallic inner shell 10 that runs continuously between an end knob 4 of the handle 2 and an end cap 8 of the barrel 6. Details of the end cap 8 and its attachment to the barrel 6 of bat 1 will be described when referring to FIG. 2 hereinafter. A tapered portion 3 of the bat 1 runs between the handle 2 and barrel 6 of the inner shell 10.

Figure 2:
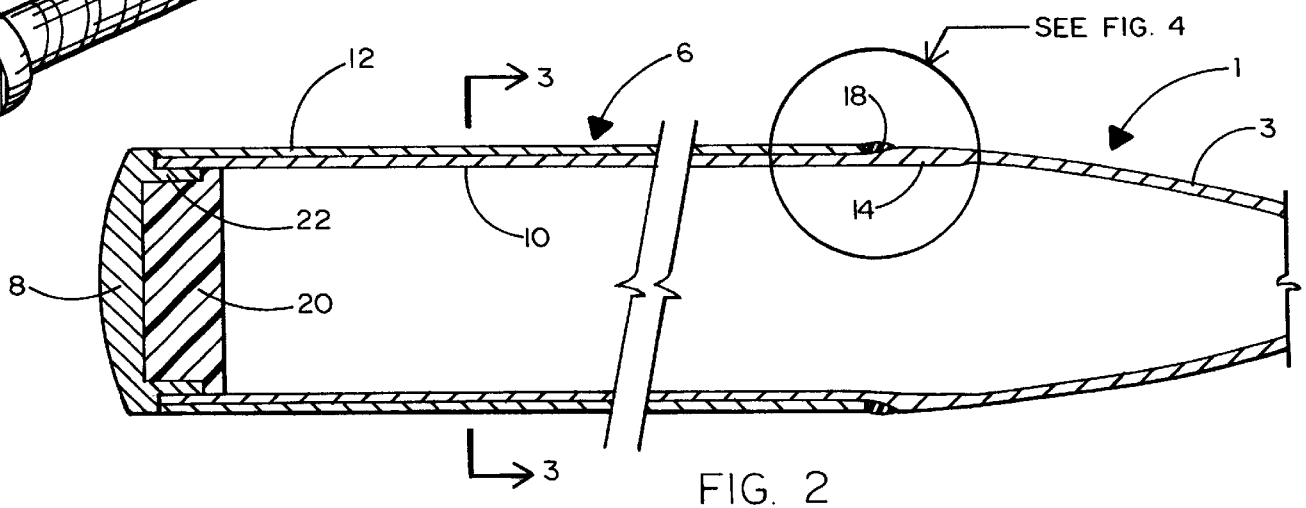
FIG. 2 is a cross-section of the bat taken along lines 2—2 of FIG. 1.
Figure 3:
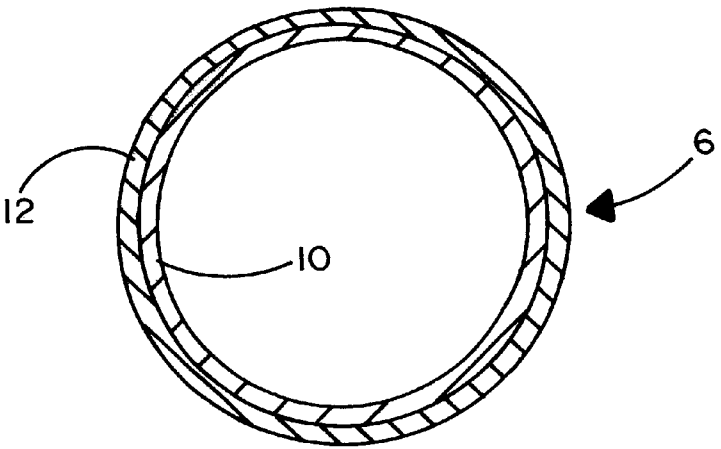
FIG. 3 is a cross-section of the bat taken along lines 3—3 of FIG. 1.

Turning now to FIGS. 2 and 3 of the drawings, a cross-section of the tapered and barrel portions 3 and 6 of the inner shell 10 of metal bat 1 of FIG. 1 is shown. In accordance with the present improvement, the bat 1 of this invention is provided with a two-part barrel structure that is adapted to isolate the hitting area and thereby enable the barrel 6 to more efficiently transfer an impact force to a softball or baseball so that the bat 1 is capable of driving the ball a longer distance compared with conventional metal bats.

More particularly, the metallic inner shell 10 of bat 1 is manufactured from aluminum, or the like. Surrounding the barrel 6 of inner shell 10 is an outer sleeve 12. The outer sleeve 12 is also preferably manufactured from aluminum, although the outer sleeve 12 can be manufactured from other metals (e.g. titanium). The inner shell 10 is swaged to fit inside the outer sleeve 12 so that the outer sleeve 12 will be held in opposing face-to-face engagement with the inner shell 10 along the entire length of the barrel 6 of bat 1.

Figure 4:
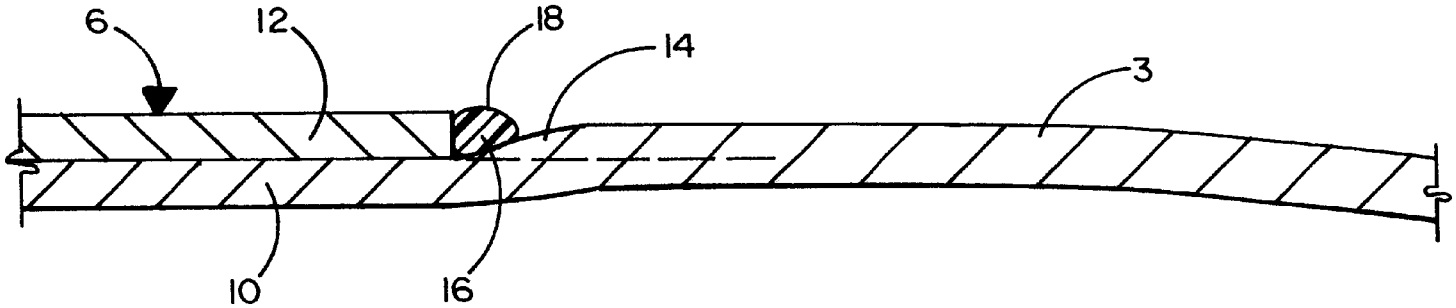
FIG. 4 is an enlarged detail of a thickness transition area of the bat shown in FIG. 2.

As is best shown in FIG. 4 of the drawings, the inner shell 10 is again swaged along the handle and tapered portions 2 and 3 thereof to produce a thickness transition area 14 at the continuous intersection of the barrel 6 with the tapered portion 3 of bat 1. That is to say, the thickness of the wall that forms the inner shell 10 is increased by approximately ten percent at thickness transition area 14 where the barrel 6 meets the tapered portion 3. As will soon be explained, the advantages of this invention are achieved by means of a double swage for holding the inner shell 10 and the outer sleeve 12 together along the barrel 6 of bat 1 and for producing the thickness transition area 14 where the wall thickness of the inner shell 10 is greater on the handle side of the tapered portion 3 and thinner on the barrel side.

As is also best shown in FIG. 4, outer sleeve 12 terminates at and is retained by the thickness transition area 14 of the inner shell 10, whereby impact and vibration forces that travel longitudinally along the outer shell 12 from the end cap 8 to the handle 2 will be better absorbed and dissipated. What is more, the thickness transition area 14 also functions to support one end of the two-part barrel 6 of the bat 1.

A small channel 16 extends circumferentially around the proximal end of the barrel 6 of bat 1 between the termination of the outer sleeve 12 and the thickness transition area 14 of the inner shell 10. The circumferential channel 16 may be filled with an optional elastomeric (e.g. rubber) sealing material 18 so as to smooth the exterior surface of the bat where the barrel 6 meets the handle 2. In the alternative, the circumferential channel 16 can remain unfilled.

A (e.g. urethane) weight 20 fills the distal end of the barrel 6 of the metal bat 1 at the interior of the inner shell 10. The weight 20 dampens the vibrations to which the distal end of the barrel 6 are subjected. Moreover, the size of the weight 20 also control the resonance of the sound waves that travel longitudinally along the bat when the barrel 6 makes contact with a ball.

The end cap 8 is inserted within the distal end of the barrel 6 of the metal bat 1 by a light press fit. The end cap 8 includes a cylindrical barrel support flange 22 that projects inwardly of bat 1 so as to engage and retain the distal-most ends of the inner shell 10 and outer sleeve 12 that form the two-part barrel 6 to preserve the face-to-face alignment thereof. The end cap 8 is affixed to the weight 20 by means of an anaerobic adhesive and several set screws (not shown). The flange 22 of end cap 8 also functions to support the opposite end of the two-part barrel 6. In other words, the proximal and distal ends of the two-part barrel 6 of bat 1 are supported by and between the thickness transition area 14 at the tapered portion 3 and the flange 22 of end cap 8.

By virtue of the inner shell 10 and the outer sleeve 12 which forms the two-part barrel 6 of metal bat 1, the hitting area of the bat is confined to the barrel and isolated from the handle 2. That is, the outer sleeve 12 of barrel 6 is supported by the inner shell 10 which, as was previously described, lays underneath the outer sleeve 12 and is coextensively connected to the handle 2 via tapered portion 3. What is more, as the isolated hitting area of the barrel 6 strikes a ball, the entire barrel 6 will be able to flex symmetrically between the opposing barrel supports at the thickness transition area 14 and the flange 22 of the end cap 8. Such symmetrical flexing makes the bat 1 more responsive during impact so as to be capable of driving the ball a greater distance in relation to the force generated during the batter's swing. In this same regard, the two-part barrel 6 of bat 1 having inner shell 10 and outer sleeve 12 spreads the point of contact along the barrel and helps to better absorb impact forces, whereby to avoid damage (e.g. dents) to the barrel.

Figure 5:
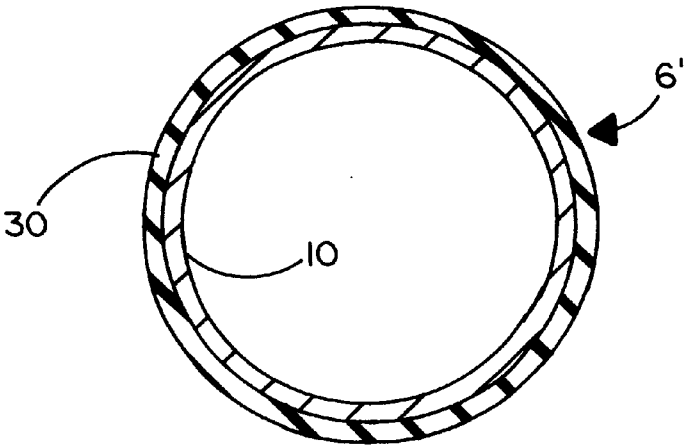
FIG. 5 shows an alternate two-part barrel structure for a baseball or softball bat.

An alternate to the two-part barrel structure for the metal bat 1 of FIGS. 1–4 is shown in FIG. 5 of the drawings. In this case, the metallic outer sleeve 12 of the barrel 6 is replaced by an elastomeric coating 30 such as, for example, urethane, or the like. It is preferable for the elastomeric coating 30 to have a thickness of between 0.050 and 0.150 inches. Therefore, a bat will be available having a two-part barrel 6' with a metallic inner shell 10 and a non-metallic outer coating 30 to provide the same advantages of an isolated hitting area and symmetrical flexing that are provided to the bat shown in FIGS. 1–4. However, with the elastomeric coating 30 of FIG. 5 replacing the metallic outer sleeve 12 of FIGS. 1–4, the overall weight of the bat will be advantageously reduced.

I claim:

1. A bat for playing softball or baseball, said bat comprising a hollow metallic inner shell including a first end having a first wall thickness and forming a handle at which the bat is gripped, a second end forming a barrel and having a second wall thickness that is thinner than the first wall thickness of said first end, and an intermediate portion having an outward taper running between said barrel and said handle and having a wall thickness that transitions between said first and second wall thicknesses, an end cap attached to the second end of said inner shell, a metallic outer sleeve surrounding the second end of said inner shell and extending continuously along the barrel thereof between said end cap and the outward taper of said intermediate portion so that a circumferential channel is established between said outer sleeve and the outward taper of said intermediate portion, and an elastomeric filler located within said circumferential channel, said outer sleeve adapted to flex in response to the bat striking a ball, and the outward taper of said intermediate portion between said barrel and said handle of said inner shell impeding the displacement of said outer sleeve during the flexure thereof.

2. The bat recited in claim 1, wherein a first end of said metallic outer sleeve surrounding said metallic inner shell is supported at said end cap, and the opposite end of said outer sleeve is spaced from the outward taper of the intermediate portion of said inner shell by said circumferential channel so that said outer sleeve will absorb and dissipate impact forces when said outer sleeve flexes in response to said bat striking a ball.

3. The bat recited in claim 2, wherein said end cap includes a cylindrical flange for supporting the first end of said metallic outer sleeve, whereby said outer sleeve is adapted to flex between the cylindrical flange of said end cap and the taper of the intermediate portion of said inner shell so as to absorb and dissipate the impact forces in response to said bat striking a ball.

4. The bat recited in claim 3, further comprising a weight located within said metallic inner shell, said weight being attached to said end cap and received within said cylindrical flange thereof.

5. The bat recited in claim 1, wherein said metallic inner shell and said metallic outer sleeve are arranged in surrounding alignment with one another by the step of swaging said metallic inner shell so as to fit inside said metallic outer sleeve.

* * * * *